US007454876B2

(12) United States Patent
Kelly

(10) Patent No.: US 7,454,876 B2
(45) **Date of Patent: *Nov. 25, 2008**

(54) FIRE RETARDANT ROOF STRUCTURE FOR STYRENE INSULATED ROOFS AND METHOD FOR MAKING THE SAME

(76) Inventor: Thomas L. Kelly, 31 Sands St., Waterbury, CT (US) 06710

( * ) Notice: Subject to any disclaimer, the term of this patent is extended or adjusted under 35 U.S.C. 154(b) by 716 days.

This patent is subject to a terminal disclaimer.

(21) Appl. No.: 10/923,929

(22) Filed: Aug. 23, 2004

(65) Prior Publication Data

US 2006/0053717 A1 Mar. 16, 2006

(51) Int. Cl.
*E04B 1/00* (2006.01)
*E04G 21/00* (2006.01)
*E04G 23/00* (2006.01)

(52) U.S. Cl. ..... 52/746.11; 52/309.4; 52/783.11; 52/784.15; 52/DIG. 15

(58) Field of Classification Search ..... 52/746.11, 52/309.4, 410, 783.11, 783.14, 309.8, 784.15, 52/676, DIG. 15, 450, 785.15
See application file for complete search history.

(56) References Cited

U.S. PATENT DOCUMENTS 2,245,689 A * 6/1941 Krueger ..... 52/88
2,484,695 A * 10/1949 Dickey et al. ..... 52/450
3,300,912 A * 1/1967 Shumaker ..... 52/39
3,397,497 A * 8/1968 Shea et al. ..... 52/334
3,956,864 A * 5/1976 Fung ..... 52/414
4,106,249 A * 8/1978 Morton ..... 52/336
4,450,663 A * 5/1984 Watkins ..... 52/309.4
4,558,550 A * 12/1985 Marchais et al. ..... 52/309.7
4,707,961 A * 11/1987 Nunley et al. ..... 52/408
5,259,157 A * 11/1993 Ault ..... 52/145
5,561,953 A * 10/1996 Rotter ..... 52/198
5,600,929 A * 2/1997 Morris ..... 52/309.8
5,842,315 A * 12/1998 Lin ..... 52/309.9
6,418,678 B2 * 7/2002 Rotter ..... 52/199
6,944,997 B2 * 9/2005 Verkamp ..... 52/309.4

* cited by examiner

*Primary Examiner*—Richard E. Chilcot, Jr.
*Assistant Examiner*—Chi Q Nguyen
(74) *Attorney, Agent, or Firm*—Cantor Colburn LLP

(57) ABSTRACT

Disclosed is a fire retardant roof system with a roof deck, a sealant material applied to the roof deck to prevent fluid migration, a polystyrene insulation board upwardly adjacent the sealant material and a sealing material upwardly adjacent the polystyrene material.

Further disclosed is a method for making a fire retardant roof structure. The method includes sealing all fluid passageways in a roof deck with a sealing material, applying a polystyrene material upwardly adjacent the roof deck and the sealing material and applying a further sealing material or cover board upwardly adjacent the polystyrene material.

9 Claims, 3 Drawing Sheets

FIRE RETARDANT ROOF STRUCTURE FOR STYRENE INSULATED ROOFS AND METHOD FOR MAKING THE SAME

BACKGROUND

Polystyrene is a very desirable insulating material due to ease of use and low cost. It is noted however that polystyrene is also an extremely flammable material when melted. This can sometimes be an issue in buildings utilizing polystyrene insulation where a building fire might have sufficient heat to melt the polystyrene insulation thereby allowing that same material to flow through any potential openings within the building or through the roof structure feeding the fire. In addition, the loss of the EPS material to the building interior leaves the roof structure uninsulated and subject to rising temperatures. Temperatures reaching 1300° Fahrenheit as the metal structural component causes structural failure. The faster the structure attains this temperature the less time is available for emergency work before building collapse. Conversely, the longer that temperature can be staved off, the longer the emergency services personnel have to do what they do. For this reason many roof systems are specified with, and installers tend to use, polyisocyanurate insulation. This type of insulation is more expensive however, and in some cases more difficult to use than expanded polystyrene. Therefore, expanded polystyrene insulation is preferred if it is possible to use safely. Many roof structures available in the market place do not provide for the use of polystyrene insulation. In inexpensive and rapidly built roof structures, one generally cannot utilize expanded polystyrene insulation unless installed in an encapsulation of lightweight concrete which would require a stronger structure to carry the weight and would facilitate liquification and delivery of the lightweight concrete. Therefore, the art will be benefited by a method and construction allowing rapid roof construction the use of polystyrene insulation while maintaining fire retardency with respect to polystyrene in low sloped commercial building structures.

SUMMARY

Disclosed is a fire retardant roof system with a roof deck, a sealant material applied to the roof deck to prevent fluid migration, a polystyrene material upwardly adjacent the sealant material and a sealing material upwardly adjacent the polystyrene material.

Further disclosed is a method for making a fire retardant roof structure. The method includes sealing all fluid passageways in a roof deck with a sealing material, applying a polystyrene material upwardly adjacent the roof deck and the sealing material and applying a further sealing material or less flammable cover board upwardly adjacent the polystyrene material.

BRIEF DESCRIPTION OF THE DRAWINGS

Referring now to the drawings wherein like elements are numbered alike in the several Figures.

DETAILED DESCRIPTION

Figure 1:
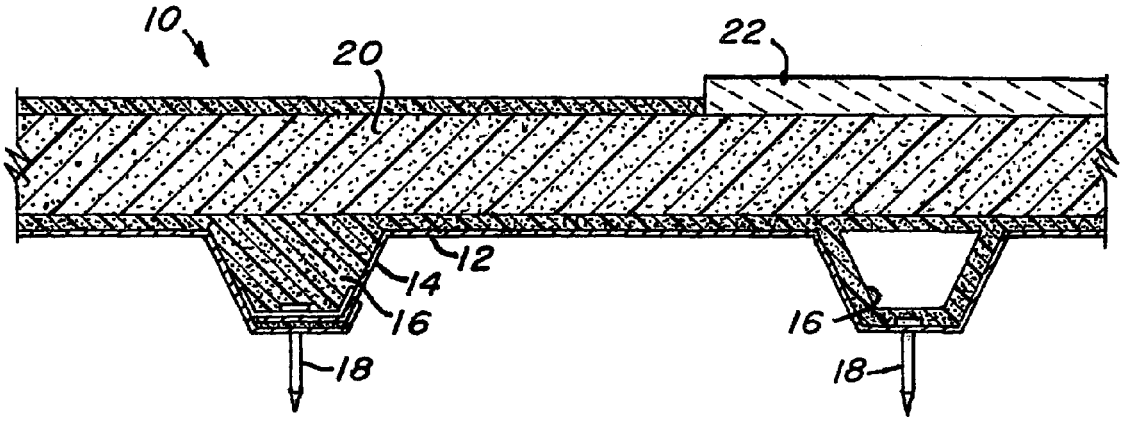
FIG. 1 is a schematic cross-sectional representation of a portion of a roof system.

Referring to FIG. 1 it is assumed that one of ordinary skill in the art will understand that the roof deck 12 that will support the roof system 10 is supported by joists or purlins not shown. In this illustration and those following herein, roof deck 12 is illustrated as a corrugated deck generally associated with being metal. Such metal decks will be recognized by one of ordinary skill in the art both in concept and in the fact that they are generally laid in panel form and include overlapping flutes 14 when installed. Also understood to one of ordinary skill in the art, such flutes 14 are generally not sealed in any particular way. Furthermore, decks such as deck 12 are generally secured to an underlying structure using fasteners that penetrate the deck.

As taught herein expanded or extruded polystyrene can be utilized as a portion of a roof system while maintaining fire retardency providing the polystyrene material is reasonably effectively encapsulated. This is not considered to mean hermetic encapsulation but rather, sufficiently encapsulated that when melted it cannot flow into the building, which has begun to burn. By preventing the flow of the melted polystyrene, the fuel that the melted polystyrene represents is not allowed to migrate to a fire source. It is also noted that the degree of fire retardency provided by the embodiments disclosed herein is different. FIG. 1 provides for minimum of fire retardency when viewed on a relative scale defined by the fire retardency of each of the embodiments described herein.

Referring back to FIG. 1, the deck 12 in accordance with the disclosure herein must be sealed to material flow. Therefore, deck 12 is subjected to application of a sealing material 16 which may be a foam or liquid material and which material may be sprayed or may be applied in liquid form. In one embodiment, the material is a polyurethane sprayable foam material. As can be ascertained from FIG. 1, material 16 is sprayed in at least all flutes of deck 12 having penetrations therethrough such as fastener 18. It is generally sufficient to provide a thin layer of material 16 in locations where it is merely a fastener penetrating roof deck 12. In overlap flute sections such as that illustrated at 14, more material 16 should be applied in order to prevent liquefied polystyrene from migrating through the roof deck 12 in that location. This is because, as one of ordinary skill in the art will appreciate, the overlap flute section includes an effective fluid pathway over the length of the overlap flute 14. This is a prime location for liquefied polystyrene to find its way into the burning building, providing more fuel to the fire. For this reason, in one embodiment, overlap flute 14 will be fully filled with material 16 to prevent migration of the liquefied polystyrene therethrough. Expanded polystyrene 20 can then be installed above material 16. In the event material 16 does not cure rapidly, the expanded polystyrene may be adhered to material 16. It is to be noted however that it is not required that polystyrene 20 is adhered to material 16 for purposes of fire retardency. If the polystyrene material 20 is not adhered to material 16 it will be weighed in place with weight such as a cover board 22 thereabove. Cover board 22 may also be adhesively attached to the polystyrene or by other means maintained in position without altering the fire retardant character of the system.

Figure 2:
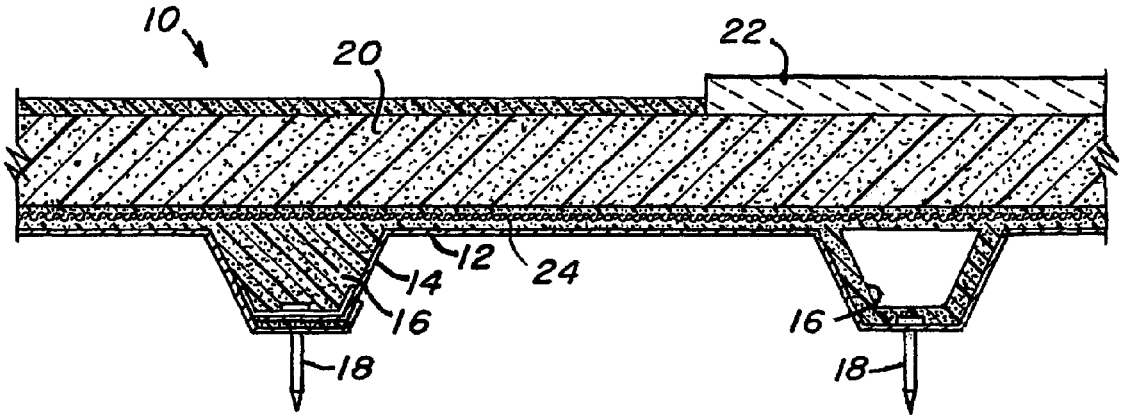
FIG. 2 similar to that of FIG. 1 but adding a matrix material.

Referring to FIG. 2, one of ordinary skill in the art having read the foregoing and referring to FIG. 1 will recognize that FIG. 2 is substantially similar thereto. Therefore, all of the numerals discussed above with respect to FIG. 1 apply to FIG. 2. The distinction between FIG. 1 and FIG. 2 is that FIG. 2 also includes a matrix material 24 installed upwardly adjacent roof deck 12 and spanning the flutes of that deck. The purpose of matrix material 24 is to hold material 16 together in the event that the internal building fire lasts for a long time or that the fire is external on the top of the roof. It is known to the art that typical sealants such as material 16 do burn but where material 24 is added to the system the burned and charred material 16 will be held in place thereby preventing liquefied polystyrene from passing therethrough. For this reason matrix material 24 is selected in one embodiment to be fireproof in its own right. For example, fiberglass mesh material is a desirable matrix material for the roof system described herein. Since fiberglass does not burn under normal circumstances, it will maintain its own structural integrity thereby retaining material 16 in a layer. Once material 16 is in fact charred, it is no longer flammable in the ordinary course. The charred material 16 in conjunction with matrix material 24 provide an effective barrier to liquefied polystyrene migrating into the building. While the structure stated will not prevent such migration indefinitely when subjected to high heat loads from the fire below, it will substantially delay entry of the liquefied polystyrene to the building thereby allowing for emergency services personnel to gain control of the fire prior to that eventuality.

Figure 3:
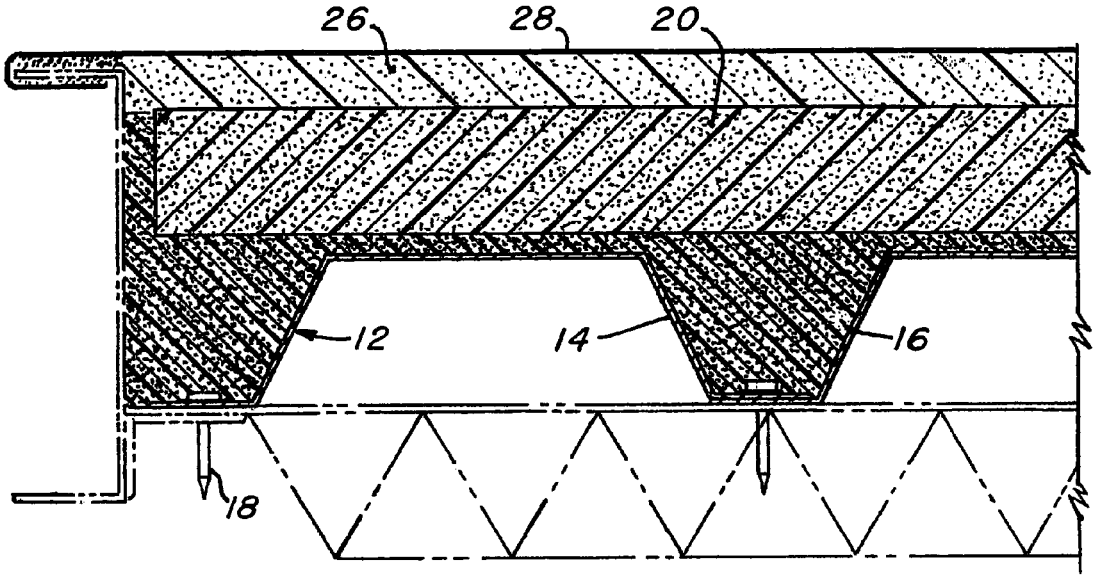
FIG. 3 is an alternate embodiment of the roof system and is described herein.

FIG. 3 presents an alternate embodiment roof system having fire retardant properties as well. In this system a matrix material is not employed, however, fire retardency is still considered high since the roof system employs a sealant 16 in an amount sufficient to substantially fill all flutes of the roof deck 12. In this particular embodiment, material 16 is illustrated as a slow rise/slow cure material (such as a specific commercial iteration of polyurethane) such that polystyrene 20 is adhered thereto upon application. Beyond fire retardency this system also creates a high strength roof system since the material layers are laminated together. Subsequent to the adherence of the polystyrene layer 20, additional sealing material such as polyurethane foam is applied as a top layer 26 above the expanded polystyrene. This layer of material 26 protects the polystyrene material 20 and further encapsulates the same. A membrane type waterproofing material 28 may be fastened to the roof system in any conventional manner. Because the polystyrene material 20 is substantially encapsulated by sealant 16 and 26, even where that material melts it cannot flow through the roof system into the underlying building.

Figure 4:
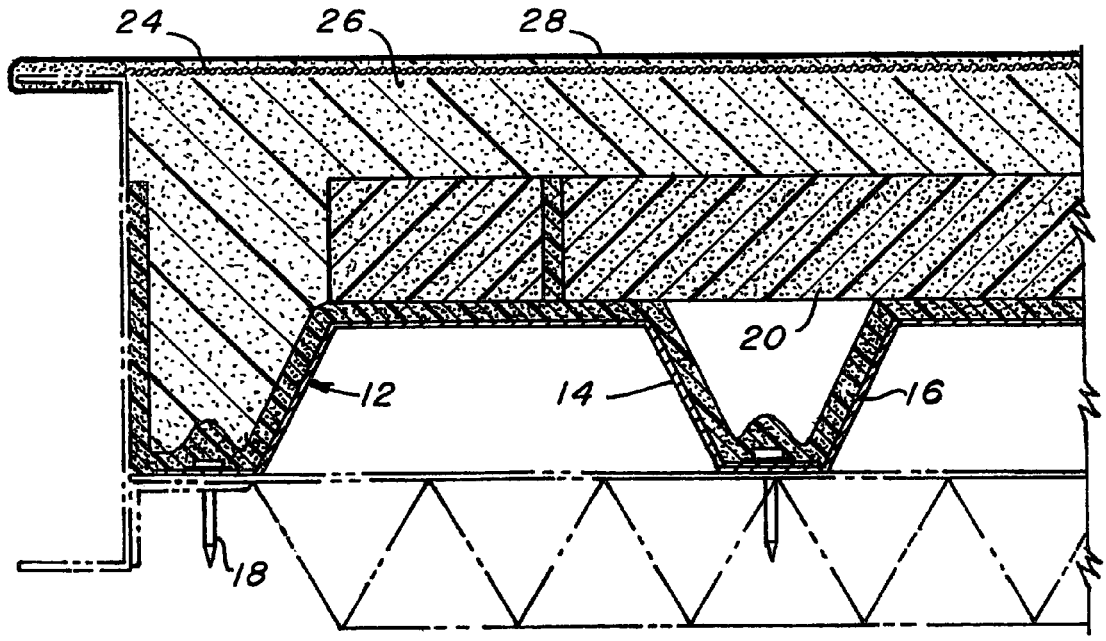
FIG. 4 is a schematic cross-sectional view of a portion of another embodiment in the roof system as described herein.

Referring to FIG. 4, another alternate embodiment of the fire retardant low cost roof system is illustrated. In this particular iteration, deck 12 is treated with a slow rise/slow cure sealant 16 to cover all potential fluid leak pathways through deck 12. Polystyrene material 20 is adhered to the slow rise/slow cure material 16 prior to curing thereof and it is noted that the polystyrene material is cut short at edge 30 such that it does not abut roof penetration structure 32. Additional material 26 is then applied upwardly adjacent and around edge 30 of polystyrene material 20. It is noted herein (equally applicable to the other embodiments hereof) that sealant material 16 or 26 may also be applied between individual boards of the polystyrene material to seal them together as well and to create smaller "encapsulations". To further enhance fire retardency of this embodiment, a matrix material 24 as described hereinabove is embedded at a top surface of material 26. This is beneficial in the event that sparks or flaming debris from the building fire which may land on other portions of the roof would be prevented from reaching the polystyrene material due to the charring of material 26 and that charred material being held together by matrix material 24.

Figure 5:
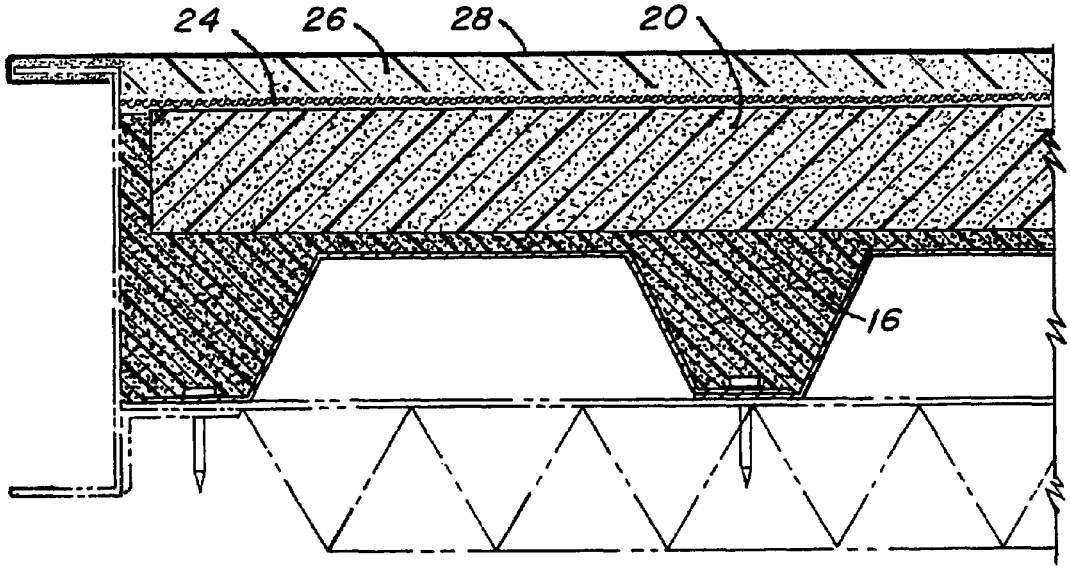
FIG. 5 is a schematic cross-sectional view of a portion of another embodiment in the roof system as described herein.

FIG. 5 is similar to FIG. 3 and the discussion therein is applicable to FIG. 5. The distinction in FIG. 5 is that a matrix material 24 is added directly above the polystyrene material 20. This improves rigidity of the roof structure and also functions as does the matrix material 24 discussed in FIG. 4.

Figure 6:
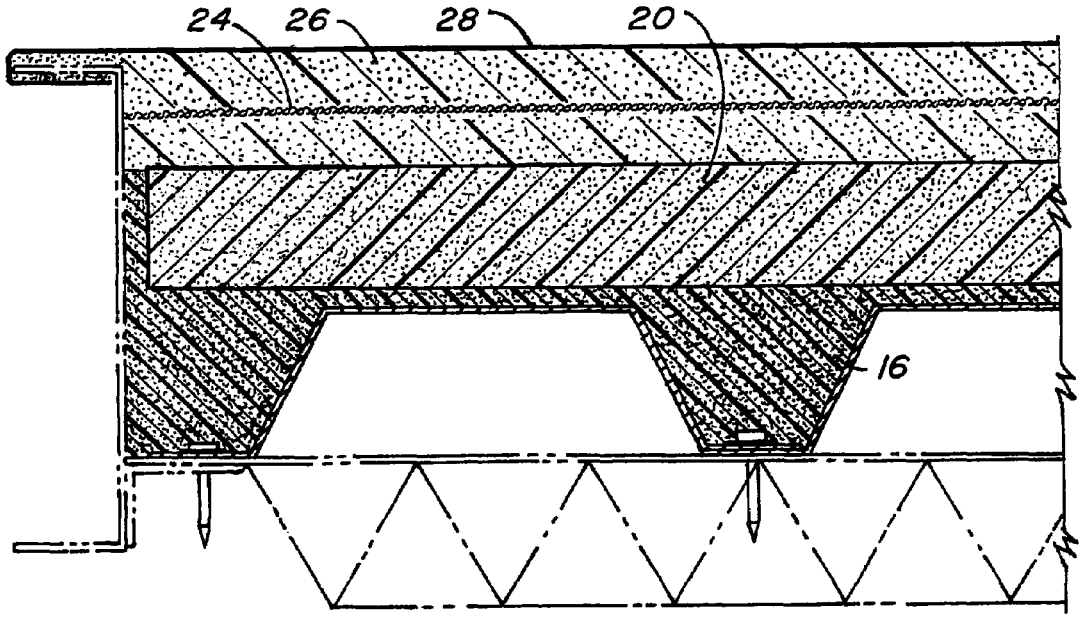
FIG. 6 is a schematic cross-sectional view of a portion of another embodiment in the roof system as described herein.

Referring now to FIG. 6, one of ordinary skill in the art will appreciate that it is nearly identical to that of FIG. 5 but that the positioning of the matrix material 24 is distinct. This positioning of matrix material 24 facilitates the application in material 26 in thicker layers individually which may be desirable in certain applications or by certain installers. The benefits of the discussion in FIGS. 4 and 5 are realized in the embodiment of FIG. 6 as well.

While preferred embodiments of the invention have been shown and described, various modifications and substitutions may be made thereto without departing from the spirit and scope of the invention. Accordingly, it is to be understood that the present invention has been described by way of illustration and not limitation.

What is claimed:

1. A method for making a fire retardant roof assembly including:

applying a slow-rise fire retardant urethane spray foam, sprayed over length and widthwise joints of a corrugated metal deck, as well as any fastener or through-deck openings in the deck, to prevent the fluid migration through the deck;

adhering polystyrene insulation to the slow-rise fire retardant urethane spray;

overspraying the abutting board butt ends, to encapsulate each polystyrene board with foam;

creating an insulation gap at perimeters, penetrations, curbs, abutting walls, and rooflop equipment a minimum of two inches, and filling gap with fire retardant slow-rise adhesive foam, to encapsulate those areas from fire exposure to the polystyrene foam;

covering the polystyrene foam with a cover layer of fire retardant urethane spray foam;

installing a single-ply waterproofing membrane over the single coat layer;

air sealing the single-ply waterproofing membrane to the cover layer spray foam cover layer at perimeters and penetrations.

2. A method for making a fire retardant roof assembly as claimed in claim 1 wherein the method further comprises adding a fiberglass reinforcing mesh cloth to the single coat layer of spray foam.

3. A method for making a fire retardant roof assembly as claimed in claim 1 wherein a conventional coverboard of gypsum is laid over the polystyrene foam.

4. A method for making a fire retardant roof assembly as claimed in claim 1 wherein a conventional coverboard of fiberboard is laid over the polystyrene foam.

5. A method for making a fire retardant roof assembly including:

applying a fire retardant polyurea coating, sprayed over length and widthwise joints of a corrugated metal deck, as well as any fastener or through-deck openings in the deck, to prevent the fluid migration through the deck;

adhering polystyrene insulation with fire retardant spray polyurea and overspraying the abutting board butt ends, to encapsulate each polystyrene board with polyurea to form a monolithic insulation;

creating an insulation gap at perimeters, penetrations, curbs, abutting walls, and rooflop equipment a minimum of ½", and filling the gap with a fire retardant polyurea to encapsulate those areas from fire exposure to the polystyrene insulation;

covering the polystyrene foam with a cover coat layer of fire retardant polyurea spray foam;

installing a single-ply waterproofing membrane over the single coat layer;

air sealing the single-ply waterproofing membrane to the single coat spray foam cover layer at perimeters and penetrations.

6. A method for making a fire retardant roof assembly as claimed in claim 5 wherein the cover layer of polyurea contains a fiberglass matrix.

7. A method for making a fire retardant roof assembly claimed in claim 5 wherein the cover board layer is a loose layer of ½" gypsum board.

8. A method for making a fire retardant roof assembly claimed in claim 5 wherein the cover board layer is an attached ½" fiberboard layer.

9. A method for making a fire retardant roof assembly claimed in claim 5 wherein the cover board layer is an attached 1" isocyanurate rigid roof insulation board.

* * * * *